United States Patent [19]

Mazzotti

[11] Patent Number: 4,852,359

[45] Date of Patent: Aug. 1, 1989

[54] PROCESS AND APPARATUS FOR MAKING CLEAR ICE CUBES

[76] Inventor: Ermanno J. Mazzotti, 2556 Bark Wood Rd. #304, Schaumburg, Ill. 60173

[21] Appl. No.: 224,888

[22] Filed: Jul. 27, 1988

[51] Int. Cl.[4] ..... F25C 1/18

[52] U.S. Cl. ..... 62/68; 62/353

[58] Field of Search ..... 62/68, 345, 66, 340, 62/356, 71, 72, 353

[56] References Cited

U.S. PATENT DOCUMENTS

| | | | |
|---|---|---|---|
| 507,005 | 10/1893 | Hill | 62/68 X |
| 828,888 | 8/1906 | Hoafnagle | 62/356 X |
| 1,113,111 | 10/1914 | Fisher | 62/68 |
| 1,296,741 | 3/1919 | Bester | 62/68 |
| 2,000,021 | 5/1935 | Hoffman et al. | 259/113 |
| 2,606,427 | 8/1952 | Kirkpatrick | 62/106 |
| 2,912,335 | 11/1959 | Haller | 99/161 |
| 3,146,606 | 9/1964 | Grimes et al. | 62/233 |
| 3,224,213 | 12/1965 | Hoyt, Jr. | 62/68 |
| 3,382,682 | 5/1968 | Frohbreter | 62/353 X |
| 3,451,227 | 6/1969 | Jacobs | 62/345 |
| 3,677,030 | 2/1972 | Nicholas | 62/353 |
| 3,727,428 | 2/1973 | Linstromberg | 62/300 |
| 3,775,992 | 12/1973 | Bright | 62/73 |
| 4,184,339 | 1/1980 | Wessa | 62/68 |

*Primary Examiner*—William E. Tapolcai
*Attorney, Agent, or Firm*—Haight & Hofeldt

[57] ABSTRACT

An ice-maker for use in a freezer compartment and a process of making clear ice cubes are disclosed. The ice-maker includes an ice-forming tray supported on a carrier body. The carrier body has a housing with an air-circulating fan directing a flow of air toward the tray during the ice-making process. The apparatus also includes means for moving the ice-forming tray during the ice-making process, to allow gases to escape so that substantially clear ice cubes are formed. In the process of the invention, the ice-maker is placed in the freezer compartment of a refrigerator. An ice-forming tray is placed on the carrier body. Cold air from the freezer compartment is blown across the tray during the ice-making process. The ice-forming tray is moved during the ice-making process to allow entrapped gases in the water to escape. With or without the air-circulating fan, the apparatus and process may cause the carrier body to move in at least two different axis. The apparatus and process may be fully automatic, with an automatic ice cube harvesting cycle in which the ice-forming tray is twisted to release the ice cubes from the tray and rotated through a predetermined arc to drop the ice cubes out of the tray.

30 Claims, 7 Drawing Sheets

Fig. 11.
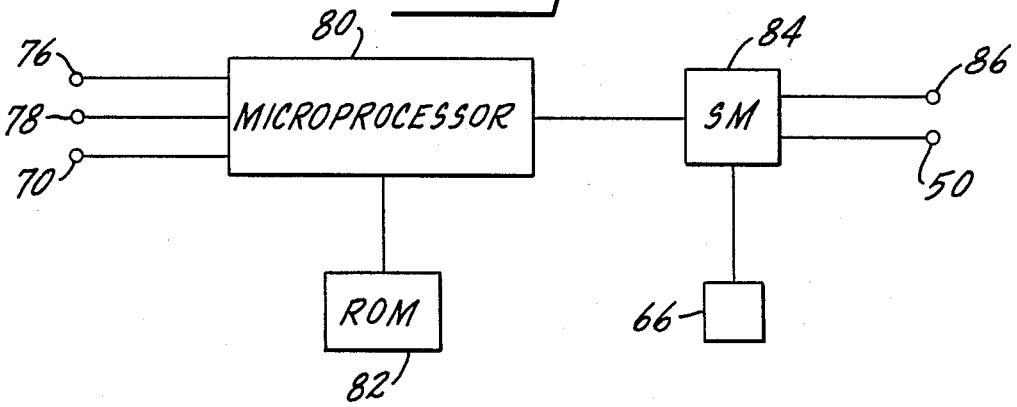
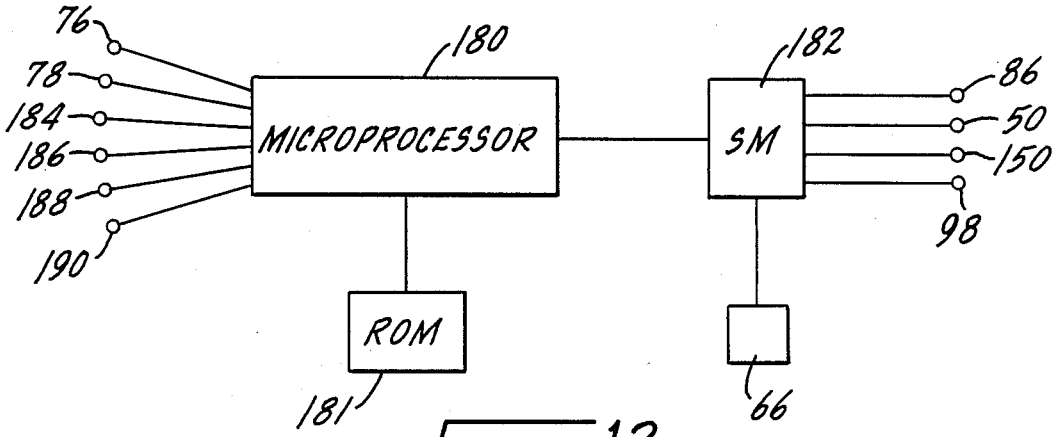
Fig. 12.

PROCESS AND APPARATUS FOR MAKING CLEAR ICE CUBES

BACKGROUND OF THE INVENTION

A. Field of the Invention

This invention relates to a process and apparatus for making clear ice cubes in conventional home refrigerators and freezers More particularly, this invention relates to such a process and apparatus for use in domestic freezers, utilizing multi-directional movement and an air-circulating fan for the rapid and efficient production of clear ice cubes.

B. Description of the Prior Art

It is generally known in the art that in conventional ice-makers, using molds and forms situated in freezer compartments, freezing water in a quiescent state permits dissolved gases to be entrapped within the ice cubes formed, reducing the clarity of the ice cubes. The art suggests a variety of methods to avoid this entrapment of gases, predominantly in large commercial ice-making apparatus.

To release entrapped gases, water has been kept in motion in commercial ice-makers with a pump which allows the water to circulate in a cascading manner over the evaporator containing the ice-forming cups during the freezing cycle. Pumps have also been used in other solutions to circulate the water by a continuous spray of water into the ice-forming cups during the ice cube freezing cycle. The art has also suggested keeping the water in motion through ultrasonic vibration, through rocking or oscillating movements about fixed pivots, and through the use of rotating paddles. To automatically harvest ice cubes, the art has also suggested a variety of mechanisms.

However, the art has been unsuccessful in providing a small, simple, efficient ice-maker for use in domestic refrigerators and freezers that is capable of efficiently making clear ice either manually or automatically.

SUMMARY OF THE INVENTION

The present invention provides an ice-making apparatus and method of making clear ice cubes. In the apparatus, the ice-maker includes an ice-forming tray which holds the water to be formed into ice cubes of any desired shape. The apparatus also includes a means for supporting at least one ice-forming tray to permit movement in at least two different axis. This means for supporting comprises a carrier body having an upright housing with means for supporting the ice-forming tray on the carrier body. The housing has air exit vents adjacent to the means for supporting the tray, and an air-circulating fan is mounted within the housing adjacent to the air exit vents to cause cool air to flow toward and across the tray during the ice-making process. The apparatus also includes means for continuously mechanically moving the ice-forming tray during the ice-making process, thereby moving the water in the tray during freezing to allow gases to escape so that substantially clear ice cubes are formed.

The apparatus may be portable with self-contained rechargeable batteries so that the apparatus may be removed when not needed to increase freezer space. With or without the air-circulating fan, the apparatus may also include means for causing the carrier body to move in at least two different axis at substantially the same time so as to keep the water in motion during freezing to produce clear ice cubes. In one embodiment, the apparatus may move the carrier body substantially simultaneously in three different axis.

The apparatus may also be fully automatic, with structures allowing for an automatic harvest cycle at the end of the ice-making cycle. In this fully automatic apparatus, the carrier body has two upright supports, with coaxial support arms rotatably mounted on one upright support, and opposing holding means rotatably mounted on the opposite upright support. Elongated rods are attached to the coaxial support arms and holding means, extending between them and supporting the longitudinal edges of the ice-forming tray. A harvest motor is mounted within a second upright housing of the carrier body. The harvest motor drives a rotatable drive wheel. A drive arm is pivotally and eccentrically connected at one end to the drive wheel, and pivotally connected at its other end to the holding means. Thus, as the harvest motor turns the drive wheel, the drive arm rotates the holding means and the ice-forming tray through a predetermined arc for release and removal of the ice cubes. Tension means are connected to one of the coaxial support arms to subject the ice-forming tray to torsion when rotation of the ice-forming tray commences. The tension means allows the ice-forming tray to complete its rotation through the predetermined arc to drop the released ice cubes out of the tray. The ice cubes may be dropped into an adjacent storage bin. Additional structures may be included to allow for the use of two ice-forming trays on the carrier body.

In the process of the present invention, an ice-maker is provided having a moveable tray carrier body with a support structure for supporting an ice-forming tray. The ice-maker may also include an air-circulating fan. The ice-maker is placed in the freezer compartment of a refrigerator. An ice-forming tray is filled with water and placed on the supporting structure of the carrier body. An automatic cycle is initiated so that the fan is activated to blow cold air from the freezer compartment across the ice-forming tray during the ice-making process, and the carrier body is continuously moved during the ice-making process to allow entrapped gases in the water to escape.

Thus, the ice-maker of the present invention provides a portable, inexpensive means of making clear ice cubes, utilizing an apparatus that may be easily installed and removed from the freezer compartment of a domestic refrigerator-freezer. Because of the compact size and shape of the apparatus of the present invention, it may easily be placed in a readily-accessible section of the freezer compartment, and may easily be removed from the freezer compartment and stored when not in use. Commonly available ice trays may be used with the ice-maker; expensive accessories are not necessary. The ice-maker of the present invention makes ice quickly, because cold ambient air from the freezer compartment is circulated over the tray as the ice cubes are forming. Also, because of the continuous mechanical movement of the carrier body and tray, the ice-maker of the present invention makes clear ice cubes.

In a preferred embodiment, the ice-maker of the present invention provides for multi-directional movement of the carrier body and ice-forming tray along at least two different axis to facilitate release of the dissolved gases entrapped in the water. In the preferred embodiment, the multi-directional movement is accomplished through the use of a means for causing the means for supporting the ice-forming tray for movement in at least two different axis to move in at least two different axis at substantially the same time so as to keep the water in motion during freezing to produce clear ice. The preferred means for causing movement comprises a simple mechanism employing at least one motorized, eccentrically-mounted weight. Two opposing motorized, eccentrically-mounted weights may be used for movement in three different axis.

The ice-maker may be powered by a set of rechargeable batteries, so that no time-consuming or expensive hook-up to the refrigerator's power supply is necessary. A variety of electronic controls may be included in either or both the semi-automatic and fully automatic embodiments of the ice-maker.

The semi-automatic ice-maker may have a proximity switch so that the ice-making cycle is automatically activated by the insertion of an ice-forming tray and is only in operation when a tray is present on the ice-maker It may have a timer that activates the fan and drive motor for a predetermined time after the tray is inserted. Additionally, a temperature sensor and calculator means may be provided so that the apparatus automatically determines freezing time and deactivates the ice-making process after the passage of that predetermined time, so that the apparatus only cycles through its ice-making cycle long enough to freeze the water in the tray. In this manner, the life of the rechargeable batteries is maximized.

The fully automatic ice-maker may also include the temperature sensor and timer, the timer being adapted to initiate the harvest cycle at the end of the ice-making cycle. It may further include an automatic fill means and water level sensor, to automatically fill the ice-forming trays and shut the water supply off when the trays are filled. Other sensors and controls may be used advantageously with the fully automatic embodiment, including: a cycle control, to pre-program the ice-maker to run through a predetermined number of cycles; a cycle sensor, to detect the number of cycles completed by the ice-maker; a cube level sensor, to detect when the ice cube storage bin is filled; and, a cup sensor, to detect whether all of the ice cubes have dropped out of the tray during the harvest cycle.

BRIEF DESCRIPTION OF THE DRAWINGS

FIG. 11 is a block diagram showing the preferred electrical control system for the semi-automatic ice-making apparatus of the present invention.

FIG. 12 is a block diagram showing the preferred electrical control system for the fully automatic ice-making apparatus of the present invention.

DESCRIPTION OF THE ILLUSTRATED EMBODIMENT

Figure 1:
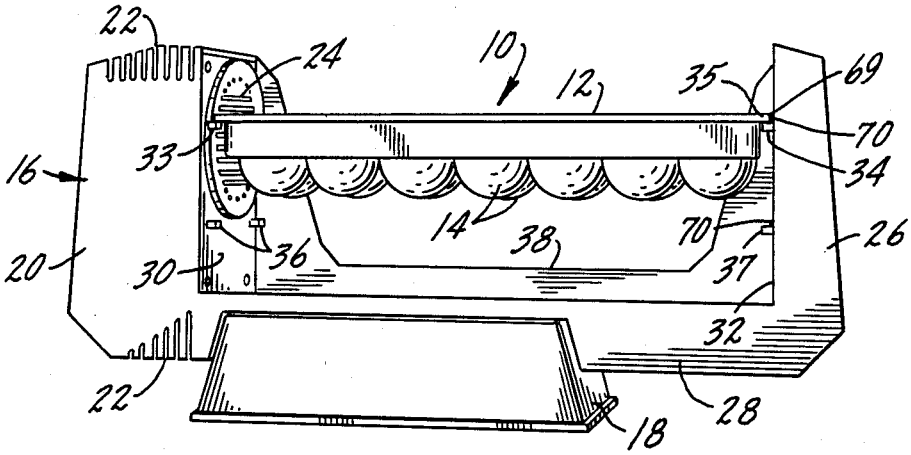
FIG. 1 is a perspective view of one embodiment of the ice-maker of the present invention.
Figure 2:
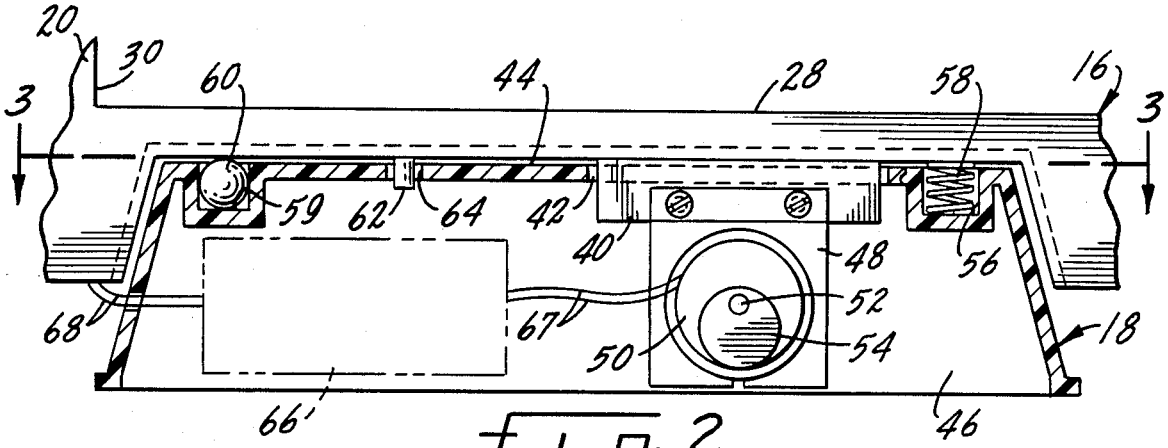
FIG. 2 is an partial cross-section of the first embodiment of the ice-maker of the present invention, showing the interior of the base of the ice-maker.
Figure 3:
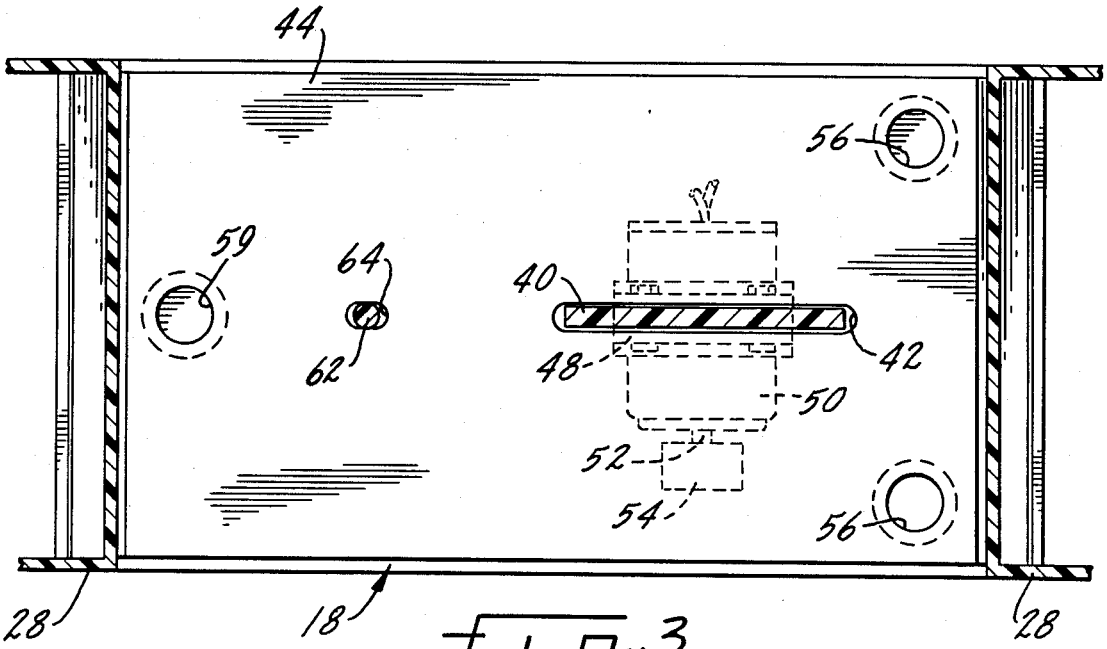
FIG. 3 is a partial cross-sectional top view of the first embodiment of the ice-maker of the present invention, essentially along line 3—3 in FIG. 2, showing the top surface of the base of the ice-maker and the elongated motor support of the carrier body.

Two embodiments of the ice-maker apparatus of the present invention are illustrated in the accompanying drawings. The apparatus illustrated in FIGS. 1-3 is a semi-automatic ice-maker 10 designed to be used in the freezer compartment of a domestic refrigerator-freezer. It includes an ice-forming tray 12 having rows of cups or pockets 14 which hold water to be frozen into ice cubes. The ice cubes may be rectangular, curved, semi-spherical or any appropriate or desired shape.

Means for supporting at least one ice-forming tray are provided. This supporting means permits movement of the ice-forming tray in at least two different axis. The illustrated supporting means includes a carrier body 16 which rests upon a base 18. During the ice-making process, the carrier body 16 moves both horizontally and vertically on the base 18, thereby moving the ice-forming tray 12 and its contained water to allow entrapped gases to escape from the water during the freezing process. Thus, substantially clear ice cubes are formed. Movement of the carrier body simultaneously along three different axis is also within the scope of the present invention.

As shown in FIG. 1, the carrier body 16 has a first upright housing 20 at one end, with air intake vents 22 and air exit vents 24. The first upright housing 20 holds a small, electrically-powered air-circulating fan (not shown). The air-circulating fan draws cold air from the freezer compartment in through the air intake vents 22 and expels the cold air through the air exit vents 24 across the tray 12, to speed the ice-making process.

The illustrated carrier body 16 is generally U-shaped in cross-section, with the first upright housing 20 defining one end of the U-shape. A second upright housing 26, opposite the first upright housing 20, defines the opposite end of the U-shape, with a bottom section 28 joining them. In the illustrated embodiment, the upright housings 20, 26 and the bottom section 28 are integral, and the bottom section is shaped to mate with the shape of the base 18. However, the carrier body could be formed from multiple units joined by appropriate fastening means.

In the first illustrated embodiment, the first upright housing 20 has an inner surface 30 on which the air exit vents 24 are disposed In the first embodiment, this inner surface 30, and an inner surface 32 of the second upright housing 26 include means for holding the tray 12 on the carrier body. As shown in FIG. 1, the first illustrated means for holding the tray on the carrier body comprises a pair of brackets 33 on the inner surface 30 of the first upright housing 20, and a pair of opposing brackets 34 on the inner surface 32 of the second upright housing 26. These pairs of brackets 33, 34 are on the same level and support end ledges 35 of the tray. Additional pairs of opposing brackets 36, 37 may be included beneath brackets 33, 34, as shown in FIG. 1, so that the ice-maker may be used for either two trays simultaneously or for one tray at a time. As shown, two pairs of brackets 33, 36 for supporting the ends of two trays, are adjacent to the air exit vents 24 so that the flow of cold air is directed over both ice-forming trays 12.

In the first illustrated embodiment, the carrier body 16 also has an integral rear wall 38, extending partially inwardly from each of the upright housings 20, 26 and partially upwardly from the bottom section 28. The rear wall 38 serves as a back-stop, to assure proper positioning of the trays on the carrier body.

As shown in FIG. 2, the illustrated ice-maker also has an elongated longitudinal motor support 40 integral with and extending downward from the bottom section 28 of the carrier body 16. The elongated motor support 40 extends through an elongated slot 42 in a top surface 44 of the base 18, and into an interior cavity 46 in the base 18. Within the cavity 46, the elongated motor support 40 is attached by bolts to a clevis 48. An electrically-powered drive motor 50 is mounted on the clevis 48. The drive motor 50 has a drive shaft 52 extending transversely to the support 40 and a weight 54 is eccentrically connected to the drive shaft 52. Thus, the drive motor 50 and weight 54 are suspended from the carrier body 16 within the interior cavity 46 of the base 18.

As shown in FIGS. 2 and 3, the top surface 44 of the base 18 of the illustrated embodiment also has a pair of sockets 56 at one end of the base. These sockets hold a pair of helical springs 58. A third socket 59 at the other end of the base, disposed substantially at the center of the base's top surface, holds a ball 60. The ball 60 is free to rotate within this socket 59. The ball 60 extends slightly above the top surface 44 of the base, as do the springs 58, so that the bottom section 28 of the carrier body 16 rests upon the ball 60 and the springs 58 and does not contact the top surface 44 of the base.

Lateral alignment of the carrier body 16 on the base 18 is maintained by the fit of the elongated motor support 40 in the elongated slot 42, and by a peg 62 extending downward from the lower surface of the bottom section 28 of the carrier body 16 through a slot 64 in the base's top surface 44. The slot 42 and slot 64 are shaped to allow the elongated motor support 40 and peg 62 to move horizontally and vertically on the base. For movement of the carrier body in three different axis, the shapes of the slots 42, 64 may be suitably modified.

A predetermined amount of horizontal movement of the carrier body 16 on the base 18 is allowed by the illustrated embodiment. To allow for such horizontal movement, the slot 64 is somewhat longer then the diameter of the peg 62, and the elongated slot 42 is somewhat longer than the elongated motor support 40. And since the ball 60 is rotatable within its socket 59, horizontal movement of the carrier body is possible. The helical springs 58 also allow for horizontal and vertical movement of the carrier body 16 on the base 18.

The structure of the carrier body and base, with the ball and springs supporting the carrier body on the base, thus allow for multi-directional movement of the carrier body on the base, and comprise the means for supporting the ice-forming tray to permit movement of the tray in at least two different axis. The drive motor, with its eccentrically mounted weight, comprises a means for causing the means for supporting to move in at least two different axis at substantially the same time so as to keep the water in motion during freezing to produce clear ice. As the drive motor 50 rotates the drive shaft 52, the eccentrically-mounted weight 54 turns, changing the center of gravity of the ice-forming tray 12 and carrier body 16. As the center of gravity changes, the illustrated carrier body moves in linear directional and a rotational direction at the same time, moving both horizontally and vertically on the ball 60 and springs 58. This movement causes the tray 12 to rock upwards and downward and from end to end about a horizontally-moveable pivot at ball 60, gently causing the water in the ice-forming tray 12 to move and thereby effecting the release of the entrapped gases in the water during the freezing process. The amplitude and frequency of the movement may be controlled by controlling the length of the slots 64, 42, the motor's revolutions per minute, and the eccentricity of weight 54.

The first illustrated embodiment may be modified to allow the carrier body to move in three different axis at the same time. A second eccentrically-mounted weight may be mounted on a second drive shaft on the motor, diametrically opposed to the illustrated drive shaft and eccentrically mounted weight. Rotation of both weights will cause the carrier body to move in three different axis on the base, a vertical axis, a horizontal axis along the length of the ice-maker 10, and a horizontal axis perpendicular thereto. The shape of the slots 64, 42 may be adjusted to accommodate the desired range of motion in these three axis.

In the illustrated embodiment, the base's interior cavity 46 also contains a power supply 66, with flexible leads 67 electrically connecting the power supply 66 to the drive motor 50, and flexible leads 68 extending out of the base and into the first upright housing 20 to electrically connect the power supply to the fan in the upright housing 20. Various power sources are within the scope of the invention. The ice-maker could use batteries, preferably rechargeable batteries, as a power supply. Alternatively, the ice-maker could be adapted to be plugged into an appropriate power outlet provided within the freezer compartment of the refrigerator or freezer.

Preferably, the semi-automatic ice-maker will also include a switch means responsive to the presence of a tray on the carrier body to activate the fan and motor when a tray is present on the carrier. In the illustrated embodiment, the tray 12 includes a magnetic strip 69 along one of the end edges of the tray. The second upright housing 26 may contain proximity switches 70 for detecting the presence of the magnetic strip 69 on the end of the tray 12. Each proximity switch 70 is positioned immediately above each pair of brackets 34, 37 on the second upright housing 26 so that the motor and fan are activated when a magnetic strip on a tray is placed adjacent to either one or both of the proximity switches. These switches will also de-activate the drive motor and fan when a magnetic strip is not adjacent to at least one switch, so that the ice-maker is de-activated when both trays are removed from the carrier body. A new freezing cycle will commence when at least one tray 12 has been removed and replaced on the support brackets 34, 37.

The ice-maker may contain a timer, adapted to deactivate the drive motor and fan after the passage of a predetermined period of time, that is, the desired length of time necessary for the freezing cycle. The timer may comprise a suitably programmed microprocessor chip. Preferably, the ice-maker also includes a temperature sensor in combination with the timer to sense the temperature and adjust the duration of the freezing cycle, based upon the ambient temperature in the freezer compartment. The temperature sensor and timer may be located in either the first or second upright housing 20, 26, the bottom section 28, or the base 18. In an even more refined embodiment, means to measure the quantity of water in the tray 12 may be provided so that the freezing time may be adjusted to compensate for different amounts of water in the tray. Further, since two trays will require more time than one tray to freeze, the cycle time can be programmed to compensate for two trays or a single tray on the apparatus.

FIG. 11 is a block diagram illustrating the preferred electrical control system for the semi-automatic ice-maker of the present invention. As illustrated, inputs from the water level sensor 76, temperature sensor 78, and proximity switch 70 are fed into a microprocessor 80. A read only memory (ROM) 82 is connected and provides control logic to the microprocessor 80. The output of the microprocessor is to an electronic switch means 84. The electronic switch means is electrically connected to the power source 66, and provides a switching mechanism for connecting the power source 66 to the fan motor 86 and drive motor 50.

The carrier body 16 and base 18 may all be made of molded thermoplastic or any other material, such as metal, suitable for use in a freezer compartment. The material should be capable of withstanding mechanical stress and the temperatures experienced in domestic freezer compartments, and should satisfy hygienic requirements.

Figure 9:
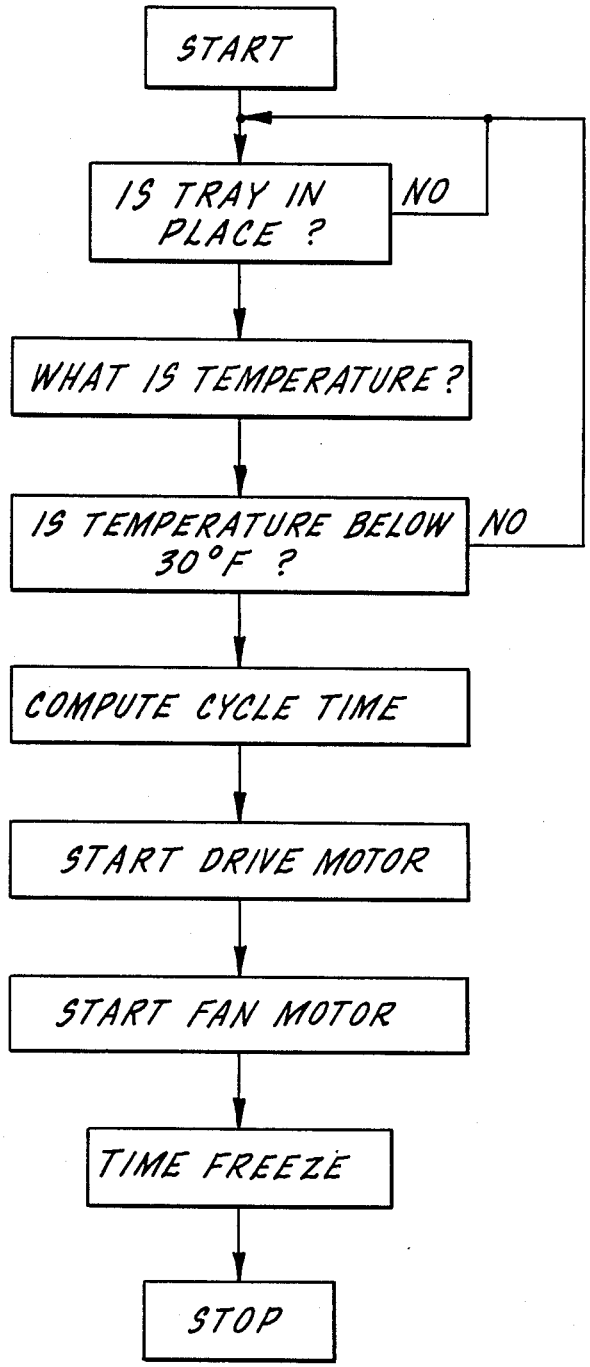
FIG. 9 is a flow diagram showing the steps of the semi-automatic ice-making process of the present invention.

The flow steps of the semi-automatic ice-making process of the present invention are summarized in FIG. 9. An ice-maker having a tray carrier body with a support structure for an ice-forming tray is provided. The carrier body is placed in a freezer compartment, such as the freezer compartment of a domestic refrigerator or freezer. Because of the compact size and shape of the illustrated embodiment of the apparatus of the present invention, it may easily be placed in a readily-accessible section of the freezer compartment, and may easily be removed from the freezer compartment and stored when not in use. The ice-forming tray is filled with water and placed on the support structure of the carrier body. The ice-maker senses whether an ice-forming tray is in place; if not, the ice-making process does not commence; if an ice-forming tray is in place, the ice-maker senses the ambient temperature in the freezer compartment through its temperature sensor. If the ambient temperature is not less than 30 degrees Fahrenheit, the ice-making process does not commence. If the ambient temperature is less than 30 degrees Fahrenheit, the ice-making cycle time is computed. The drive motor is activated, to start rotating the eccentric weight, and the fan motor is activated. Cold air from the freezer compartment is blown across the tray by the fan during the freezing cycle. The carrier body and tray are also continuously mechanically moved during the freezing cycle to allow entrapped gases to escape from the water. Preferably, the carrier body and tray are moved in both the horizontal and vertical directions, or in three directions, simultaneously during the ice-making process. At the end of the computed time for the ice-making cycle, the fan motor and drive motor are shut off.

Additional steps that may be included in the ice-making process of the present invention are detecting the level of water in the ice-forming trays and the number of trays on the carrier body and computing the cycle time based upon the ambient temperature, the number of trays, and the level of water (ergo, the quantity) in the ice-forming trays.

It should also be understood that the apparatus and process of the present invention may be used without an air-circulating fan. The fan speeds up the freezing of the water in the tray. Clear ice cubes may be made by causing the carrier body to move in at least two different axis at the same time utilizing, for example, the above described suspended motor, eccentric weight or weights, springs and ball.

The apparatus and process of the present invention may be used with an automatic fill means for filling the ice-forming trays with water within the freezer compartment. Such automatic fill means are known in the art and may be advantageously combined with the present invention to make a fully automatic continuous ice cube maker. The apparatus and process of the present invention may also be used in combination with known mechanical apparatuses and processes for automatically expelling the ice cubes from the ice-forming tray so that clear ice may be continuously and automatically made and removed from the tray into a storage container without human intervention.

A second, fully automatic embodiment of the present invention, generally designated 95, employing a novel means for automatically harvesting the ice cubes, is illustrated in FIGS. 4–8. As in the first embodiment, the ice-maker of the second illustrated embodiment has an ice-forming tray for holding water to be frozen into ice cubes, means for supporting at least one ice-forming tray to permit movement of the tray in at least two different axis, and means for causing the means for supporting the ice-forming tray to move in at least two different axis at substantially the same time. As in the first illustrated embodiment, the means for supporting the ice-forming tray in the second illustrated embodiment includes a carrier body 16 set upon a base 18. In the second illustrated embodiment, the air-circulating fan system and means for causing the supporting means and ice-forming tray to move during the ice-making process are essentially the same as those shown in the first illustrated embodiment. The same reference numbers have been used for the same parts in both illustrated embodiments. However, the second illustrated embodiment incorporates several different or additional elements for fully automatic functioning.

Figure 4:
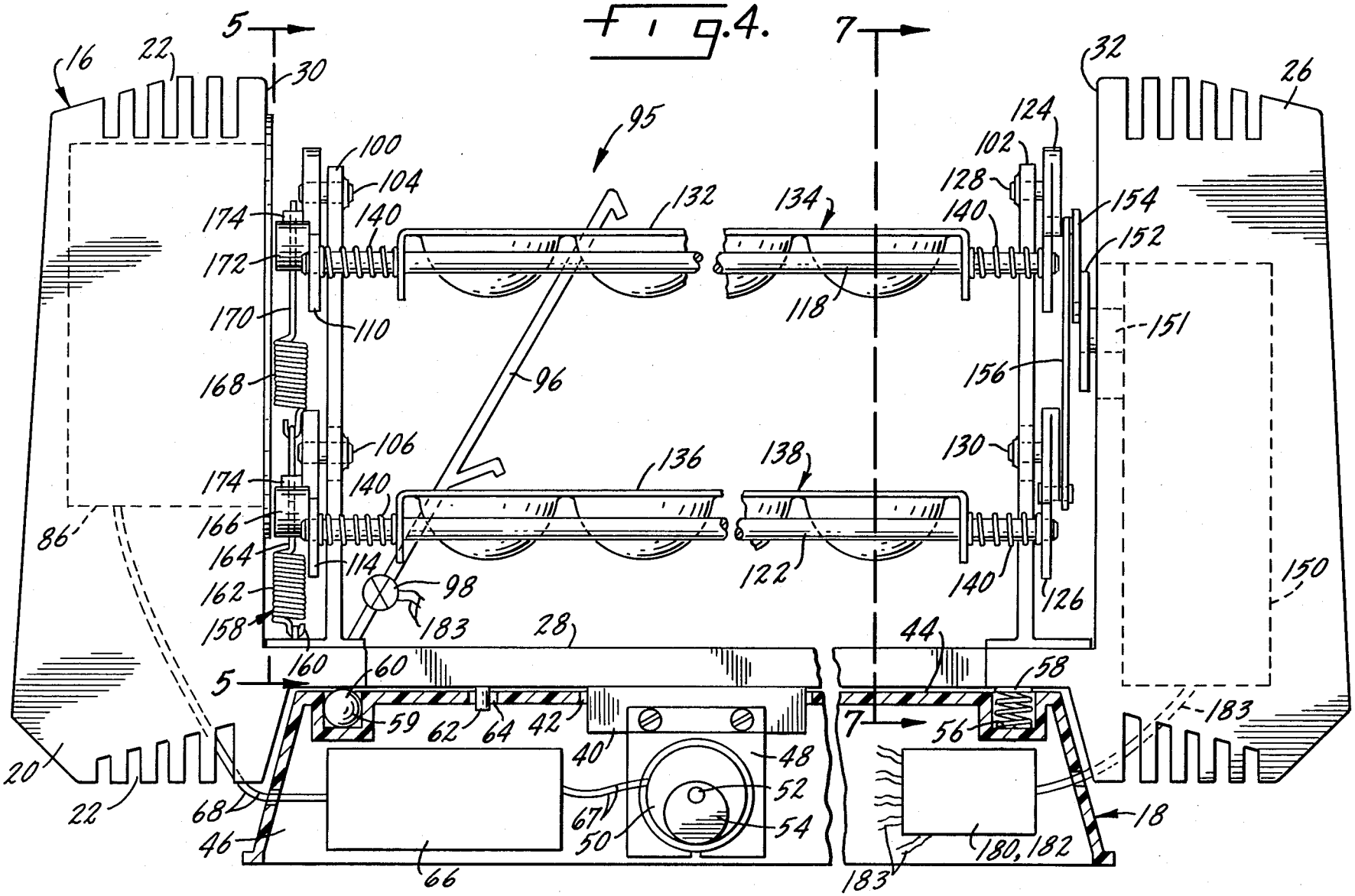
FIG. 4 is a perspective view of a second, fully automatic embodiment of the ice-maker of the present invention.

As shown in FIG. 4, automatic fill means may be used in the fully automatic embodiment, including a water supply line 96 and solenoid 98 for controlling a valve in the water supply line. In this embodiment, the means for supporting the ice-forming trays on the carrier body includes a first upright support 100 spaced from a second upright support 102, each extending upwardly from the bottom section 28 of the carrier body 16, near the inner surfaces 30, 32 of the first upright housing 20 and second upright housing 26.

Figure 5:
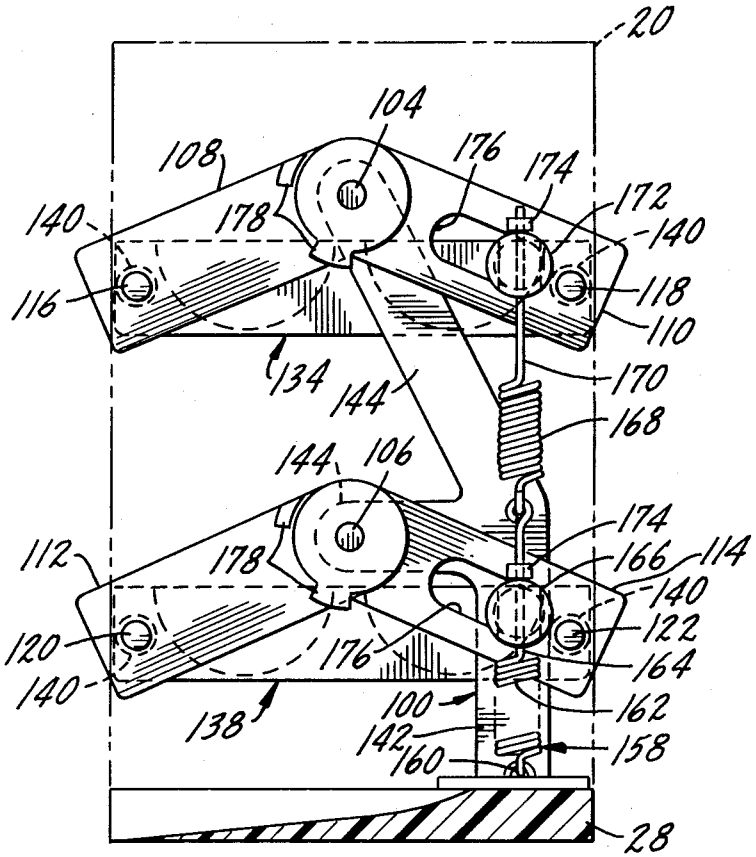
FIG. 5 is a cross-sectional view of the second embodiment of the ice-maker of the present invention, taken along line 5—5 of FIG. 4, showing the position of the coaxial support arms and ice-forming trays during the ice-making cycle.
Figure 6:
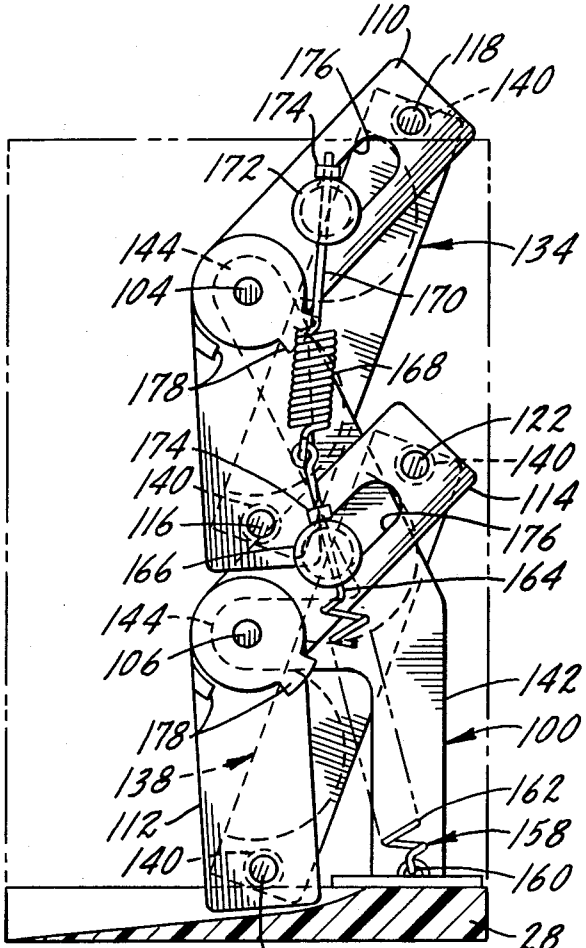
FIG. 6 is a cross-sectional view of the second embodiment of the ice-maker of the present invention, taken along line 5—5 of FIG. 4, showing one position of the coaxial support arms and ice-forming trays during the ice-harvesting cycle.

As shown in FIGS. 5 and 6, the first upright support 100 has two vertically aligned axles 104, 106 extending outwardly towards the inner surface 30 of the first upright housing 20. The top axle 104 extends through bores in first ends of a top pair of coaxial support arms 108, 110, and the bottom axle 106 extends through bores in first ends of a similar bottom pair of coaxial support arms 112, 114 so that the first ends of each pair of coaxial support arms are pivotally joined at their respective axles. Each arm of the top pair 108, 110 may rotate independently of the other arm on the top axle 104, as may each arm of the lower pair 112, 114 on the bottom axle 106.

The second ends of the top coaxial support arms 108, 110 extend in opposite directions to form a top elongated flexible member. This top flexible member is thus rotatably mounted at the first ends of the top coaxial arms to the first upright support 100 on the top axle 104. The second ends of the bottom coaxial support arms 112, 114 similarly extend in opposite directions to form a bottom elongated flexible member. This bottom elongated flexible member is similarly rotatably mounted at the first ends of the bottom coaxial arms to the first upright support 100 on the bottom axle 106. The second ends of the top pair of coaxial arms are fixed to the first ends of a top pair of spaced parallel elongated rods 116, 118; the second ends of the bottom coaxial support arms 112, 114 are fixed to the first ends of a bottom pair of spaced parallel elongated rods 120, 122.

The opposite, second ends of the top pair of spaced parallel elongated rods 116, 118 are connected to opposing ends of a top holding means 124, and the opposite, second ends of the bottom pair of spaced parallel rods 120, 122 are connected to opposing ends of a bottom holding means 126. The top and bottom holding means 124, 126 are rotatably mounted about their centers on top and bottom axles 128, 130 extending outwardly from the second upright support 102, between the second upright support 102 and the inner face 32 of the second upright housing 26. The top and bottom axles 128, 130 are vertically aligned, opposite the top and bottom axles 104, 106 on the first upright support 100.

The top pair of elongated rods 116, 118 support the longitudinal sides 132 of the top ice-forming tray 134 between the first and second ends of the rods; the bottom pair of elongated rods 120, 122 support the longitudinal sides 136 of the bottom ice-forming tray 138 between the first and second ends of the rods. The elongated rods extend through bores in each end of each ice-forming tray and along each longitudinal side of each tray. The opposing top axles 104, 128 are set at the same level so that the top ice-forming tray 134 is level; similarly, the opposing bottom axles 106, 130 are set at the same level so that the bottom ice-forming tray 138 is also level. The top and bottom axles, top and bottom pairs of coaxial support arms, and top and bottom holding means are spaced to allow for clearance when the ice-forming trays are turned during the ice harvesting cycle.

As shown in FIG. 4, each elongated rod 116, 118, 120, 122 has a helical spring 140, encircling the rod at each end between the holding means 124, 126, coaxial support arms 108, 110, 112, 114, and the ends of the ice-forming trays 134, 138. The helical springs 140 serve to maintain the positions of the ice-forming trays on the elongated rods 116, 118, 120, 122.

Figure 7:
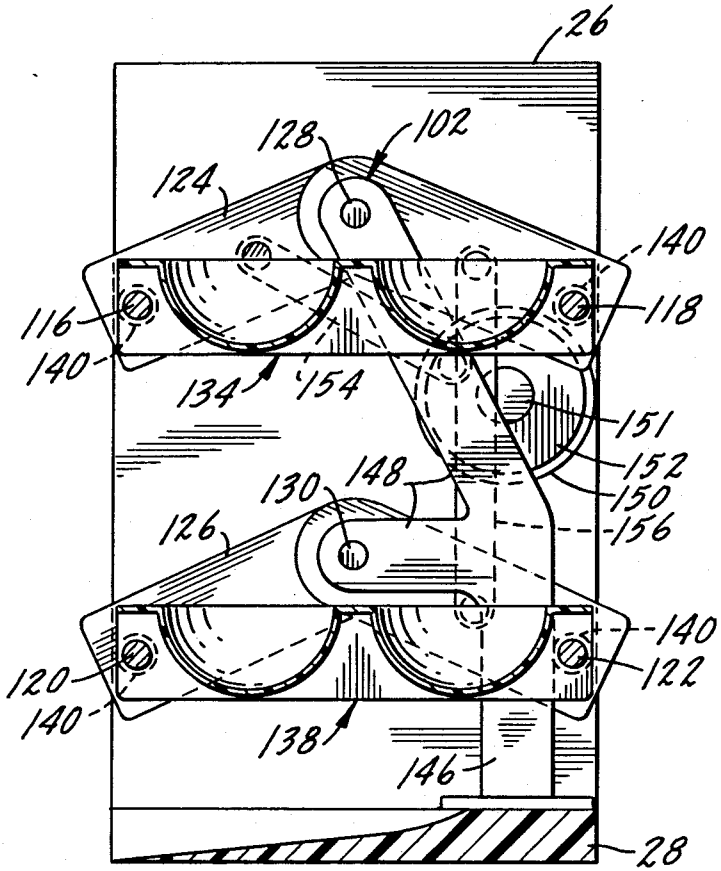
FIG. 7 is a cross-sectional view of the second embodiment of the ice-maker of the present invention, taken along line 7—7 of FIG. 4, showing the position of the holding means and ice-forming trays during the ice-making cycle.
Figure 8:
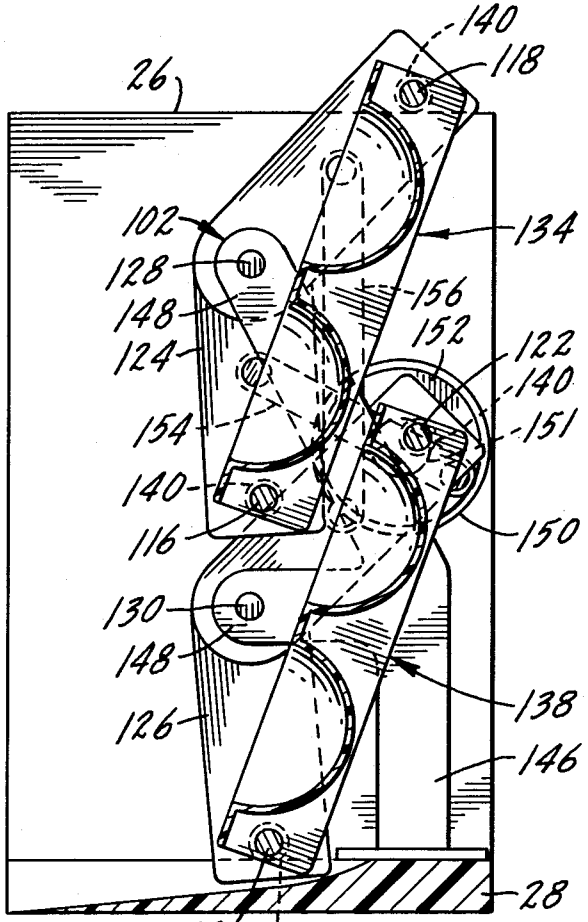
FIG. 8 is a cross-sectional view of the second embodiment of the ice-maker of the present invention, taken along line 7—7 of FIG. 4, showing the position of the holding means and ice-forming trays during the ice-harvesting cycle.

As shown in FIGS. 5 and 6, the first upright support 100 has a vertical segment 142 set off from the centers of the ice-forming trays and first upright housing 20 of the carrier body 16, with side segments 144 extending from the vertical segment 142 toward the center of the ice-forming tray and first upright housing. The axles 104, 106 extend from the ends of these side segments 144 at the center of the carrier body. As shown in FIGS. 7 and 8, the second upright support 102 is similarly shaped, with an off-center vertical segment 146 and side segments 148 extending toward the centers of the ice-forming trays, the holding means 124, 126 being rotatably mounted at the ends of the side segments 148 at the centers of the ice-forming trays. With the upright supports 100, 102 so shaped, the ice-forming trays, elongated rods, coaxial arms, and holding means may be turned or rotated through a predetermined arc without interference from the upright supports. In the second illustrated embodiment, the ice-forming trays and associated structures are rotated through an arc of about 70 degrees during the ice-harvesting cycle to release the ice-cubes from the ice-forming trays and to drop the released ice cubes into a storage bin placed alongside the ice-maker.

To harvest the ice-cubes, the ice-forming trays are rotated by an electrically-powered harvest motor 150 mounted within the second upright housing 26. As shown in FIGS. 4, 7 and 8, the harvest motor is connected through a drive shaft 151 to a drive wheel 152. A drive arm 154 is pivotally and eccentrically connected at one end to the drive wheel 152; the other end of the drive arm 154 is pivotally connected to the top holding means 124. A connecting rod 156 is pivotally connected at one end to the top holding means; the other end of the connecting rod is pivotally connected to the bottom holding means 126.

Thus, the harvest motor 150 drives the drive wheel 152, rotating the drive wheel through a full circle, thereby pushing and pulling the drive arm 154 between its two extreme positions, shown in FIGS. 7 and 8. As the drive arm is pushed and pulled, the top holding means is turned through an arc of about 70 degrees. As the top holding means 124 turns through this arc, the connecting rod 156 causes the bottom holding means 126 to simultaneously turn through the same predetermined arc of about 70 degrees. As the top and bottom holding means turn, the top and bottom pairs of elongated rods 116, 118, 120, 122 and top and bottom ice-forming trays 134, 138 turn about longitudinal axis defined by the opposing top and bottom axles 104, 106, 128, 130.

When the drive wheel 152 has been rotated to its halfway point, having rotated through a semi-circle, it has pushed the drive arm 154 to its extreme position, shown in FIG. 8. There, the holding means 124, 126 and ice-forming trays 134, 138 have thereby been turned through the predetermined arc of about 70 degrees, and the ice cubes may drop or slide out of the trays and into the adjacent ice cube storage bin. When the drive wheel completes is rotation, the drive arm is pulled back to its initial position and the holding means and ice-forming trays are rotated back to their initial position, shown in FIG. 7.

In order for the ice cubes to readily drop out of the ice-forming trays, the ice cubes should first be released or dislodged from the trays. To release the ice cubes from the ice-forming trays, the second illustrated embodiment provides for twisting the ice-forming trays. Tension means are provided near one corner of each ice-forming tray to subject the ice-forming trays to a predetermined degree of torsion when rotation of the ice-forming tray commences to cause release of the ice cubes from the ice-forming tray as the tray is rotated. The tension means allows the ice-forming tray to complete its rotation through the predetermined arc to allow the released ice cubes to drop out of the ice-forming tray into the adjacent storage bin.

As shown in FIGS. 4–6, the illustrated tension means comprises a spring member 158 having a hooked end 160 secured to the carrier body 16. An integral first helical spring section 162 extends from the hooked end 160. An integral straight section 164 extends from the first helical spring section 162 through a bore in a first lug 166; a portion of the straight section 164 extending beyond the lug is threaded. A second helical spring section 168 is connect to the first threaded straight section 164. An integral second straight section 170 extends through a bore in a second lug 172, and terminates in a threaded end. Threaded nuts 174 are screwed onto the threaded straight sections 164, 170 to secure the spring member 158 to the lugs 166, 172. The two lugs 166, 172 are secured in slots 176 in the top and bottom coaxial support arms 110, 114, on one side of the ice-maker, as shown in FIGS. 5 and 6, and are slidable therein. Other structures may be utilized as suitable tension means, and are within the scope of the invention; for example, separate springs could be used for each pair of coaxial support arms.

Thus, when the harvest motor 150 begins to turn the holding means 124, 126 and pairs of elongated rods 116, 18, 120, 122, the spring member 158 provides tension on one of each pair of coaxial support arms 110, 114. The spring member 158 thereby provides tension on an end of one of each pair of elongated rods 118, 120, and thereby on one corner of each ice-forming tray 134, 138. Since the coaxial support arms may rotate or flex with respect to each other, the ice-forming trays are thereby twisted at the beginning of the ice harvesting cycle. The degree of twisting or torsion may be controlled by limiting the degree of relative movement between the pair of coaxial support arms; in the second illustrated embodiment, this control is accomplished through stops 178 provided on each coaxial support arm.

As the harvest motor 150 begins to turn the corner of the ice-forming trays in tension, the lugs 166, 172 slide in the slots 176 in the coaxial support arms 110, 114, releasing the tension on the trays. With the tension released, the ice-forming trays 134, 138 may return to their original shape and complete their partial revolution and drop the released ice cubes out of the ice-forming trays, as shown in FIG. 6.

As indicated, the illustrated coaxial support arms 108, 110, 112, 114 are independent elements. They may be made of molded thermoplastic or other material suitable for use in the environment of a freezer compartment. An integral element could be used for each pair of coaxial support arms, provided it allowed for the flexing action allowed by the illustrated independent elements. In the at rest position shown in FIG. 5, each pair of coaxial support arms defines an inverted V-shaped flexible member. Each holding means 124, 126 defines a similar inverted V-shaped member. In the second illustrated embodiment, each holding means is an integral piece; however, each holding means may comprise independent elements joined together.

As shown in FIG. 12, a microprocessor 180 is preferably included in the fully automatic ice-maker, with inputs from a temperature sensor 78 and water level sensor 76. The microprocessor 180 has a pre-programmed read only memory 181 and an output to an electronic switch means 182. As in the first embodiment, the electronic switch means 182 is electrically connected to the power source 66, and provides a switching mechanism for automatically activating and shutting off the fan motor 86 and drive motor 50. Other electronic sensors and controls may be used advantageously in the fully automatic embodiment, as shown in FIG. 12.

As shown in FIG. 4, the electronic controls, including the microprocessor 180 and switch means 182 are connected by a plurality of pairs of leads 183 to the power source 66, the fan, the drive motor 50 and the harvest motor 150. Although not shown in FIG. 4, the microprocessor would also be electrically connected to the various sensors which may be used in the fully automatic embodiment.

In the second illustrated embodiment, the electronic switch means 182 is also electrically connected to the freezer's solenoid 98, to control the water flow to the ice-maker from the freezer's water supply line 96. The microprocessor should direct a shut off of the water supply line when the water level has reached a predetermined level in the ice-forming trays. This control may also be used to prevent flooding of the freezer compartment, shutting off all water flow when the water level has reached a predetermined level. Additional input to the microprocessor preferably senses when the ice-forming trays are empty; when empty trays are so detected, the output of the microprocessor and switch to the solenoid should direct the opening of the water supply line so that the trays may be refilled with water to commence another cycle, if other control conditions are met.

As shown in FIG. 12, a cycle control 184, electrically connected to the microprocessor 180, may be used as a means for automatically controlling the number of ice-making cycles completed before the ice-maker is shut off. Preferably, controls are provided so that the user may pre-program the ice-maker to complete a predetermined number of cycles and then shut off automatically. For example, the number of harvest cycles necessary for filling the storage bin may be predetermined and the cycle control set at this number. A cycle sensor 186, to automatically detect the number of harvest cycles completed by the ice-maker, would preferably be used in conjunction with the cycle control, as an additional input into the microprocessor.

A cube level sensor 188, in the storage bin, may be electrically connected to the microprocessor, and may be used as a means of detecting when the storage bin is full of ice cubes. When the bin is full, the microprocessor and electronic switch can then shut the ice-maker off. Such cube level sensors are known in the art and may be used advantageously in the present invention.

In the second illustrated embodiment, the electronic switch means 182 is also electrically connected to the harvest motor 150. Thus, the harvest motor may be automatically shut off at the completion of the ice harvesting cycle, and automatically activated to harvest the ice cubes when an ice-making cycle has finished.

A cup sensor 190 may also be used advantageously to detect whether all of the cups of the ice-forming tray have been emptied during the ice harvesting cycle. If some ice cubes remain in some of the cups, the harvest motor may continue to run through another cycle to empty the remaining cups. After all of the cups of each ice-forming tray have been emptied, the harvest motor may be shut off by the microprocessor and electronic switch.

The microprocessor used in either embodiment may be provided in the form of a printed circuit board. The temperature sensor may be located on the printed circuit board. Since the microprocessor will be used in a freezer compartment, it should be capable of withstanding temperatures ranging down to about zero degrees Fahrenheit without suffering any ill effects. The microprocessor should also be able to withstand temperatures up to about 110 degrees Fahrenheit, since the ice-maker may be stored outside of the freezer compartment when not in use. Since the microprocessor in either illustrated embodiment may be connected to the freezer's electrical system or power supply, the microprocessor should satisfy electronic qualification tests such as the electrostatic discharge test (mil-std 883 B), the NEMA arc test (ICS-2-230), the surge withstand capability test (ANSI/C 37.90*a*), and burn in testing (100%).

Figure 10:
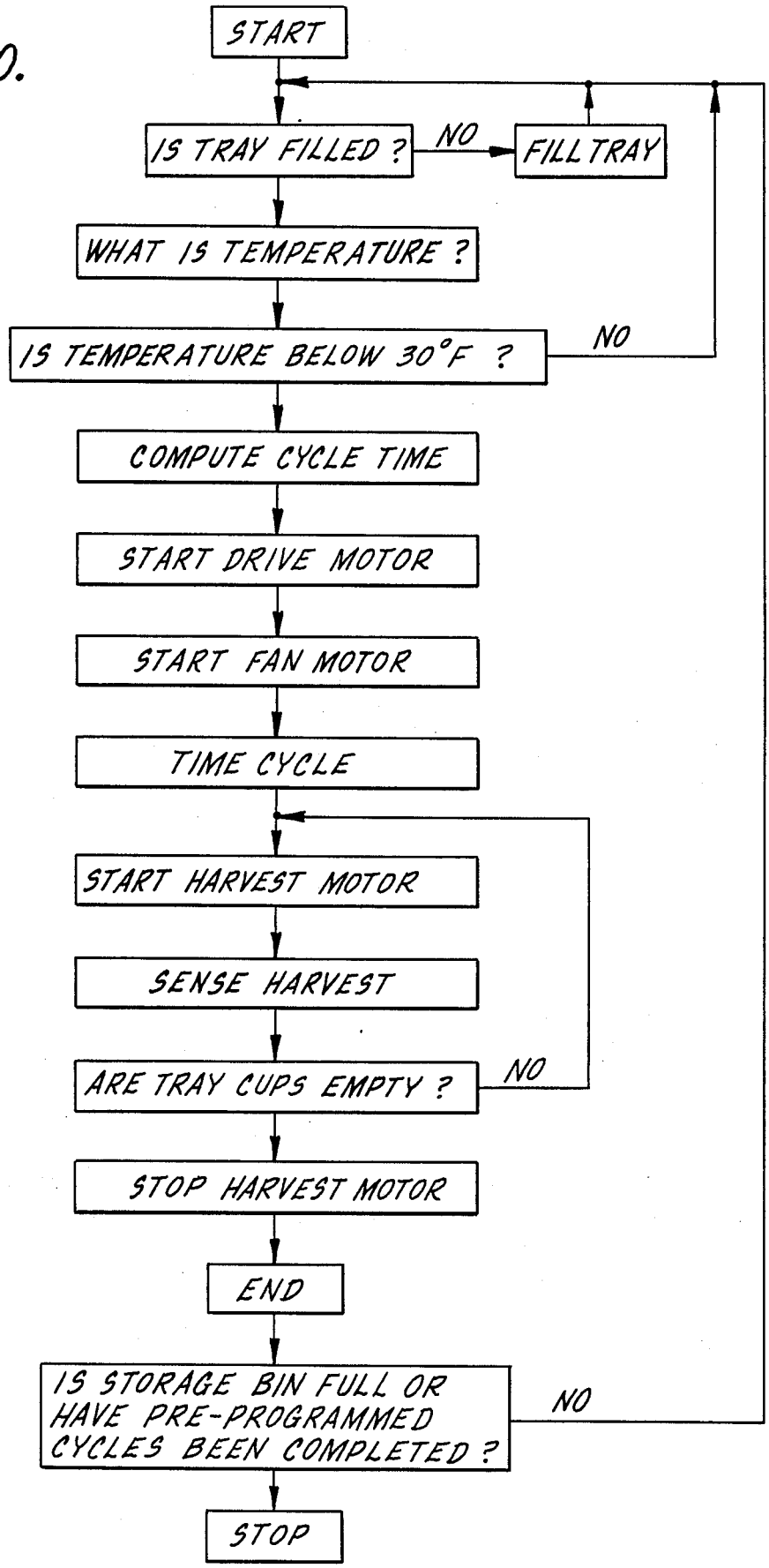
FIG. 10 is a flow diagram showing the steps of the fully automatic ice-making process of the present invention.

The steps of the fully automatic process are summarized in FIG. 10. The ice-maker first senses whether the ice-forming trays are filled with water. If not, the ice-making cycle does not commence; preferably, the microprocessor would then direct the solenoid to open the water supply line to fill the trays with water. If the ice-forming trays are full, the ice-maker detects the ambient temperature in the freezer compartment. If the ambient temperature is more than 30 degrees Fahrenheit, the ice-making cycle does not commence. If the ambient temperature is less than 30 degrees Fahrenheit, the ice-maker computes the freezing cycle time for the detected temperature and starts the drive motor, to rotate the eccentric weight, and the fan motor, to direct cold air across the ice-forming trays. At the end of the computed freezing cycle time, the harvest motor is activated. The activated harvest motor turns the drive wheel, and the ice-forming trays are thereby twisted about their longitudinal axis to release the ice cubes. The harvest motor turns the ice-forming trays through an arc of about 70 degrees, and the released ice cubes drop from the ice-forming trays into the adjacent storage bin. The ice-maker then senses the harvest and senses whether the cups of the ice-forming trays are empty. If the cups are not empty, the harvest motor runs through another harvest cycle. If the cups are empty, the harvest motor is shut off, and the ice-maker either shuts off completely or commences another ice-making and harvest cycle, dependent upon the level of cubes in the storage bin or the number of pre-programmed cycles.

Although the invention has been described with respect to the illustrated embodiments, it should be understood that the invention is not limited to these embodiments. Additions or modifications may be made by those skilled in the art without departing from the scope of the invention as defined by the claims.

I claim:

1. A clear ice-maker for use in a freezer compartment comprising:

an ice-forming tray for holding water to be formed into ice cubes;

a carrier body for supporting the tray, the carrier body having a housing with air exit vents, means for supporting the tray on the carrier body so that the tray is adjacent to the air exit vents, and a fan mounted within the housing adjacent to the air exit vents to direct a flow of air toward the tray during the ice-making process; and means for moving the ice-forming tray during the ice-making process to allow gases to escape from the water so that substantially clear ice cubes may be formed in the tray;

wherein said means for moving the ice-forming tray during the ice-forming process moves the carrier body linearly and rotates the carrier body about a moveable pivot at the same time.

2. An ice-maker as claimed in claim 1 wherein the carrier body is substantially U-shaped in cross-section, the ice-maker further comprising:

a base disposed under the carrier body, the base having a top surface and defining an interior cavity;

a spring disposed between the top surface of the base and the carrier body;

a ball disposed between the top surface of the base and the carrier body, the ball and the spring being spaced from each other;

a motor suspended from the carrier body and disposed within the base cavity, the motor having a rotatable drive shaft; and a weight eccentrically mounted on the drive shaft, so that as the motor turns the drive shaft, the weight rotates eccentrically, causing the carrier to undergo both linear and rotational movement on the base at the same time.

3. An ice-maker as claimed in claim 2 further comprising means for maintaining lateral alignment of the carrier body on the base.

4. An ice-maker as claimed in claim 2 wherein the top surface of the base has a slot and further comprising a motor support extending downward from the carrier body through the slot and into the interior cavity of the base and attached to the motor within the interior cavity of the base, the length of the motor support being less than the length of the slot to allow a predetermined amount of linear movement of the carrier on the base.

5. An ice-maker as claimed in claim 2 further comprising a switch means responsive to the presence of a tray on the carrier to activate the fan and drive motor when an ice-forming tray is present on the carrier.

6. An ice-maker as claimed in claim 5 further comprising a timer to de-activate the fan and motor after the ice-forming tray has been present on the carrier for a predetermined period of time.

7. An ice-maker as claimed in claim 6 wherein the predetermined time is variable and dependent upon the ambient temperature in the freezer compartment, the ice-maker further comprising an ambient temperature sensor means electrically connected to the timer for controlling the time during which the fan and motor are activated dependent upon the ambient temperature in the freezer compartment.

8. An ice-maker as claimed in claim 2 further comprising a plurality of batteries mounted in the ice-maker and electrically connected to the fan and motor for supplying power to the fan and motor.

9. An ice-maker as claimed in claim 1 wherein the means for moving the ice-forming tray includes means for rocking the carrier body about a linearly moveable pivot during the ice-making process.

10. An ice-maker as claimed in claim 1 wherein the carrier body includes a second housing disposed opposite the first housing and the means for supporting the ice-forming tray on the carrier body comprises:

a first support disposed adjacent to the first housing of the carrier body;

a second support disposed adjacent to the second housing;

a pair of coaxial support arms, a first end of each pivotally joined and second ends extending in opposite directions to form an elongated flexible member, said flexible member rotatably mounted at the first ends to said first support;

a pair of elongated rods having first and second ends, said first ends of each of said rods respectively mounted to a respective second end of said coaxial support arms and extending longitudinally therefrom;

holding means rotatably mounted about its center on the second support, said holding means having two opposing ends respectively attached to respective second ends of said elongated rods;

said ice-forming trays being disposed on the pair of elongated rods between said first and second ends of said pair of elongated rods;

wherein the ice-maker further comprises:

a harvest motor means mounted within the second housing for rotating said elongated rods and ice-forming tray through a predetermined arc for release and removal of the frozen ice cubes;

tension means connected to one of the coaxial support arms to subject the ice-forming tray to a predetermined degree of torsion when rotation of the ice-forming tray commences to cause release of the ice-cubes from the ice-forming tray as the ice-forming tray is rotated.

11. An ice-maker as claimed in claim 10 further comprising:

a drive shaft extending from the harvest motor means;

a rotatable drive wheel mounted on the drive shaft and driven by the harvest motor means;

a drive arm having one end pivotally and eccentrically mounted on the drive wheel and a second end pivotally mounted on the holding means to rotate the holding means through a predetermined arc as the drive wheel is turned by the harvest motor, to thereby rotate the elongated rods and ice-forming tray through the predetermined arc for release and removal of the ice cubes from the ice-forming tray.

12. An ice-maker as claimed in claim 10 further comprising:

a second ice-forming tray spaced from the first ice-forming tray;

a second pair of coaxial support arms each having first and second ends, a first end of each pivotally joined and second ends extending in opposite directions to form an elongated flexible member, said flexible member rotatably mounted at the first ends to said first support spaced from said first pair of coaxial support arms;

a second pair of elongated rods having first and second ends, said first ends of each of said second rods respectively mounted to a respective second end of said second coaxial support arms and extending longitudinally therefrom;

second holding means rotatably mounted about its center on the second support spaced from said first holding means, said second holding means having two opposing ends respectively attached to respective second ends of said second pair of elongated rods;

said second ice-forming tray being disposed on the second pair of elongated rods between the first and second ends of the second pair of elongated rods;

a connecting rod having one end pivotally attached to the first holding means and an opposite end pivotally attached to the second holding means to turn the second ice-forming tray through a predetermined arc with the turning of the first tray;

one arm of the second pair of coaxial arms being connected to the tension means to subject the second ice-forming tray to a predetermined degree of torsion when rotation of the second ice-forming tray commences to cause release of the ice cubes from the second ice-forming tray as the second ice-forming tray is rotated.

13. A process for making clear ice cubes in an ice-forming tray comprising the steps of:

placing an ice-maker having a moveable carrier body with a supporting structure for holding the ice-forming tray and a fan for blowing air across the ice-forming tray in a freezer compartment;

filling the ice-forming tray with water;

activating the fan to blow cold air across the ice-forming tray during the ice-making process; and causing the ice-forming tray to undergo both linear motion and rotational motion about a moveable pivot simultaneously and continuously during the ice-making process to allow gases in the water to escape and produce clear ice.

14. A process as claimed in claim 13 wherein the step of causing the ice-forming tray to undergo both linear and rotational motion continuously during the ice-making process is accomplished by rocking the carrier body about a linearly moveably pivot.

15. A process as claimed in claim 13 wherein the step of causing the ice-forming tray to move is accomplished by activating a motor suspended from the carrier body to rotate an eccentrically mounted weight to continuously change the center of gravity of the tray during the ice-making process.

16. A process as claimed in claim 11 further comprising the steps of:

detecting the presence of a tray on the supporting structure of the carrier by a proximity sensing means;

providing electrical power to the fan and the motor when the presence of a tray is detected by the proximity sensing means;

sensing the ambient temperature when the presence of a tray is detected;

determining the proper time period for completion of the ice-making process based upon receipt of a signal corresponding to the sensed ambient temperature; and terminating electrical power to the fan and the motor after completion of said time period.

17. A process as claimed in claim 13 further comprising the steps of:

twisting the ice-forming tray about its central longitudinal axis after completion of the ice-making process to release the ice cubes from the ice-forming tray; and turning the ice-forming tray through a predetermined arc to allow the released ice cubes to drop out of the ice-forming tray.

18. A clear ice-maker for use in a freezer compartment comprising:

an ice-forming tray for holding water to be frozen into ice-cubes;

means for supporting at least one ice-forming tray to permit said tray to undergo both linear and rotational movement;

means for causing said means for supporting to undergo both linear movement and rotational movement about a moveable pivot at substantially the same time so as to keep the water in motion during freezing to produce clear ice.

19. A clear ice-maker as claimed in claim 18 wherein the means for supporting at least one ice-forming tray to permit said tray to undergo linear and rotational movement comprises a carrier body substantially U-shaped in cross-section, the ice-maker further comprising:

a base for supporting said carrier body and allowing for linear and rotational movement of the carrier body;

a spring disposed between the base and the carrier body;

a ball disposed between the base and the carrier body, the ball and spring being spaced from each other and supporting the carrier body to allow for said linear and rotational movement of the carrier body.

20. A clear ice-maker as claimed in claim 18 wherein the means for supporting at least one ice-forming tray to permit said tray to move linearly and to rotate comprises a carrier body substantially U-shaped in cross-section and the means for causing linear and rotational movement of said means for supporting comprises a motor suspended from the carrier body, the motor having a drive shaft, and a weight eccentrically mounted on the drive shaft to cause the carrier body to move linearly and to rotate as the weight is rotated by the drive shaft, the ice-maker further comprising a base for supporting the carrier body and allowing for linear and rotational movement.

21. A clear ice-maker as claimed in claim 20 wherein the mans for causing linear and rotational movement of said means for supporting further comprises a second drive shaft driven by the motor and a second weight eccentrically mounted on the second drive shaft.

22. A clear ice-maker as claimed in claim 18 wherein the means for supporting at least one ice-forming tray comprises a carrier body substantially U-shaped in cross-section, the ice-maker further comprising a base for supporting said carrier body and allowing for linear and rotational movement of the carrier body at substantially the same time, and wherein the means for causing linear and rotational movement of said means for supporting includes means for rocking the carrier body about a linearly moveable pivot on the base.

23. A clear ice-maker as claimed in claim 18 further comprising a plurality of batteries serving as a self-contained electrical power supply for the means for causing said means for supporting to move.

24. An ice-maker as claimed in claim 18 wherein the means for supporting it least one ice-forming tray to permit movement of said tray in at least two different axis comprises:

a carrier body;

a first support disposed at one end of the carrier body;

a second support disposed at the other end of the carrier body;

a pair of coaxial support arms, a first end of each pivotally joined and second ends extending in opposite directions to form an elongated flexible member, said flexible member rotatably mounted at the first ends to said first support;

a pair of elongated rods having first and second ends, said first ends of each of said rods being respectively mounted to a respective second end of said coaxial support arms and extending longitudinally therefrom;

holding means rotatably mounted about its center on the second support, said holding means having two opposing ends respectively attached to respective second ends of said elongated rods;

said ice-forming tray being disposed on the pair of elongated rods between said first and second ends of said pair of elongated rods;

wherein the ice-maker further comprises:

a harvest motor means mounted within the carrier body for rotating said elongated rods and ice-forming tray through a predetermined arc for release and removal of the frozen ice-cubes;

tension means connected to one of the coaxial support arms to subject the ice-forming tray to a predetermined degree of torsion when rotation of the ice-forming tray commences to cause release of the ice-cubes from the ice-forming tray as the ice-forming tray is rotated.

25. An ice-maker as claimed in claim 24 further comprising:

a second ice-forming tray spaced from the first ice-forming tray;

a second pair of coaxial support arms each having first and second ends, a first end of each pivotally joined and second ends extending in opposite directions to form an elongated flexible member, said flexible member rotatably mounted at the first ends to said first support spaced from said first pair of coaxial support arms;

a second pair of elongated rods having first and second ends, said first ends of each of said rods being respectively mounted to a respective second end of said second coaxial support arms and extending longitudinally therefrom;

second holding means rotatably mounted about its center on the second support spaced from said first holding means, said second holding means having two opposing ends respectively attached to respective second ends of said second elongated rods;

said second ice-forming tray being disposed on the second pair of elongated rods between said first and second ends of said second pair of elongated rods;

a connecting rod having one end pivotally attached to the first holding means and an opposite end pivotally attached to the second holding means to turn the second ice-forming tray through a predetermined arc with the turning of the first tray;

one arm of the second pair of coaxial arms being connected to the tension means to subject the second ice-forming tray to a predetermined degree of torsion when rotation of the second ice-forming tray commences to cause release of the ice-cubes from the second ice-forming tray as the second ice-forming tray is rotated.

26. A process for making clear ice cubes in an ice-forming tray comprising the steps of:

placing an ice-maker having means for supporting at least one ice-forming tray to permit both linear and rotational movement of said tray in a freezer compartment of a refrigerator-freezer;

positioning the ice-forming tray on said means for supporting at least one ice-forming tray, said ice-forming tray containing water; and causing the means for supporting at least one ice-forming tray to move in a linear direction and to rotate about a moveable pivot at substantially the same time so as to keep the water in the ice-forming tray in motion during freezing to produce clear ice cubes.

27. A process as claimed in claim 26 further comprising the steps of:

activating a harvest motor to twist the ice-forming tray after the completion of the ice-making process to release the ice cubes from the ice-forming tray; and turning the ice-forming tray through a predetermined arc by means of the harvest motor to allow the released ice cubes to drop out of the ice-forming tray so that the ice cubes are automatically harvested at the end of the ice-making cycle.

28. An ice-maker comprising:

an ice-forming tray for holding water to be frozen into ice cubes;

means for supporting at least one ice-forming tray to permit movement of said tray in at least two different axis including:

a carrier body;

a first support disposed at one end of the carrier body;

a second support disposed at the other end of the carrier body;

a pair of coaxial support arms, a first end of each pivotally joined and second ends extending in opposite directions to form an elongated flexible member, said flexible member rotatably mounted at the first ends to said first support;

a pair of elongated rods having first and second ends, said first ends of each of said rods being respectively mounted to a respective second end of said coaxial support arms and extending longitudinally therefrom;

holding means rotatably mounted about its center on the second support, said holding means having two opposing ends respectively attached to respective second ends of said elongated rods;

said ice-forming tray being disposed on the pair of elongated rods between the first and second ends of the pair of elongated rods;

wherein the ice-maker further comprises:

a harvest motor means mounted within the carrier body for rotating said elongated rods and ice-forming tray through a predetermined arc for release and removal of the frozen ice-cubes;

tension means connected to one of the coaxial support arms to subject the ice-forming tray to a predetermined degree of torsion when rotation of the ice-forming tray commences to cause release of the ice-cubes from the ice-forming tray as the ice-forming tray is rotated.

29. An ice-maker as claimed in claim 28 further comprising:

a drive shaft extending from the harvest motor means;

a rotatable drive wheel mounted on the drive shaft and driven by the harvest motor means;

a drive arm having one end pivotally and eccentrically mounted on the drive wheel and a second end pivotally mounted on the holding means to rotate the holding means through a predetermined arc as the drive wheel is turned by the harvest motor, to thereby rotate the elongated rods and ice-forming tray through the predetermined arc for release and removal of the ice cubes from the ice-forming tray.

30. An ice-maker as claimed in claim 28 further comprising:

a second ice-forming tray spaced from the first ice-forming tray;

a second pair of coaxial support arms each having first and second ends, a first end of each pivotally joined and second ends extending in opposite directions to form an elongated flexible member, said flexible member rotatably mounted at the first ends to said first support spaced from said first pair of coaxial support arms;

a second pair of elongated rods having first and second ends, said first ends of each of said rods being respectively mounted to a respective second end of said second coaxial support arms and extending longitudinally therefrom;

second holding means rotatably mounted about its center on the second support spaced from said first holding means, said second holding means having two opposing ends respectively attached to respective second ends of said second elongated rods;

said second ice-forming tray being disposed on the second pair of elongated rods between the first and second ends of the second pair of elongated rods;

a connecting rod having one end pivotally attached to the first holding means and an opposite end pivotally attached to the second holding means to turn the second ice-forming tray through a predetermined arc with the turning of the first tray;

second tension means connected to one arm of the second pair of coaxial support arms to subject the second ice-forming tray to a predetermined degree of torsion when rotation of the second ice-forming tray commences to cause release of the ice-cubes from the second ice-forming tray as the second ice-forming tray is rotated

* * * * *